US006736498B2

(12) United States Patent
Blum

(10) Patent No.: US 6,736,498 B2
(45) Date of Patent: May 18, 2004

(54) EYELID POSITIONING

(75) Inventor: John N. Blum, Somerset, NJ (US)

(73) Assignee: Eastman Kodak Company, Rochester, NY (US)

( * ) Notice: Subject to any disclaimer, the term of this patent is extended or adjusted under 35 U.S.C. 154(b) by 16 days.

(21) Appl. No.: 10/254,816

(22) Filed: Sep. 25, 2002

(65) Prior Publication Data

US 2004/0056932 A1 Mar. 25, 2004

(51) Int. Cl.[7] ..... B41J 2/185; B41J 2/165
(52) U.S. Cl. ..... 347/90; 347/30
(58) Field of Search ..... 347/90, 75, 76, 347/29, 35, 36, 30, 73

(56) References Cited

U.S. PATENT DOCUMENTS 6,247,781 B1 * 6/2001 Blum ..... 347/29
6,527,363 B1 * 3/2003 Bowling et al. ..... 347/36
6,688,733 B1 * 2/2004 Huliba ..... 347/76
6,688,736 B1 * 2/2004 Tunmore et al. ..... 347/90

* cited by examiner

*Primary Examiner*—Kristal J Feggins
(74) *Attorney, Agent, or Firm*—Barbara Joan Haushalter

(57) ABSTRACT

An eyelid positioning technique is provided for an ink jet printer to precisely position the eyelid relative to the catcher to properly seal the print head. The eyelid seals against the catcher to contain ink within the printhead on startup and shutdown of the printer system. An eyelid actuator assembly moves the eyelid into a sealed position for startup and shutdown and into an open position for print, so that ink jets can exit an array of orifices and pass between the catcher and the eyelid to print on a print media. At least one alignment flexure capability allows for precise positioning of the eyelid relative to the catcher or the drop generator during assembly of the printer system.

14 Claims, 6 Drawing Sheets

EYELID POSITIONING

TECHNICAL FIELD

The present invention relates to continuous ink jet printing and, more particularly, to placement of an eyelid seal relative to a catcher pan by means of various flexures.

BACKGROUND ART

Ink jet printing systems are known in which a print head defines one or more rows of orifices which receive an electrically conductive recording fluid from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

When the ink jet print head is not in operation, means must be provided to seal the print head so that ink does not dry in the catcher face area, or weep from the jets and soil the apparatus or adjacent work surfaces. In continuous ink jet printing systems, the eyelid is a moveable seal which diverts ink on startup into the catcher, thereby recycling the ink while containing it within the printhead. The seal is formed against the lip of the metal catch plate, which is typically about 0.025 inches thick. The eyelid opens about 0.04 inches while the printer is printing, allowing the ink drops to pass onto the print media.

As a continuous ink jet printer starts up in preparation for printing, it is necessary to divert the partially formed jets and blobs of ink into a catcher and evacuate ink from the vicinity of the charge leads. The eyelid is a moveable seal which diverts the ink and seals on its lower edge against the catcher pan. A small gap ("0.020") exists between the face of the seal and the radius of the catcher. If this gap is too small, the flow of ink into the catcher throat can be restricted. This can result in a failure at printhead startup as ink overflows the eyelid as the pressure transitions from low to high. A large gap between the eyelid and catcher radius will create a recirculation zone in the throat of the catcher, which also causes ink to flow over the eyelid. Both situations can lead to startup failures. Similarly, an eyelid seal which is too high will obstruct the catcher throat, also leading to startup failures. If the eyelid seal is located too low, the seal between the eyelid and the catcher pan may leak.

One way of achieving an exact placement of the eyelid seal to the catcher pan is through tightening the part tolerances. The eyelid and catcher components are precisely fabricated, creating a precise assembly. However, this method leads to increased part cost and is difficult to implement as the part count increases.

It is seen then that there exists a need for an improved eyelid positioning technique which can be used to precisely locate the rubber seal of an eyelid relative to the catcher.

SUMMARY OF THE INVENTION

This need is met by the improved eyelid positioning technique according to the present invention, wherein exact placement of an eyelid seal relative to a catcher pan is achieved by means of various flexures. With the technique of the present invention, an eyelid may be easily adjusted so that it properly diverts partially formed jets and blobs of ink into a catcher as the ink jet printer starts up.

In accordance with one aspect of the present invention, an eyelid positioning technique for an ink jet printer precisely positions the eyelid relative to the catcher to properly seal the print head.

Accordingly, it is an object of the present invention to provide an improved positioning means for orienting the eyelid relative to the printhead frame or catcher.

Other objects and advantages of the invention will be apparent from the following description, the accompanying drawings and the appended claims.

DETAILED DESCRIPTION OF THE PREFERRED EMBODIMENTS

Eyelids are typically oriented in ink jet printing systems to move with respect to the catch pan, allowing the printer to startup if in the closed position or to print if in the open position. The motion may comprise rotation about a pivot, sliding or translation, or a multiple link mechanism. While those skilled in the art will recognize that the teachings of the present invention are applicable to all of these devices, for purposes of description, the technique of the present invention will be described relative to a multiple link eyelid assembly, such as is described and claimed in U.S. Pat. No. 6,247,781, totally incorporated herein by reference.

Figure 1:
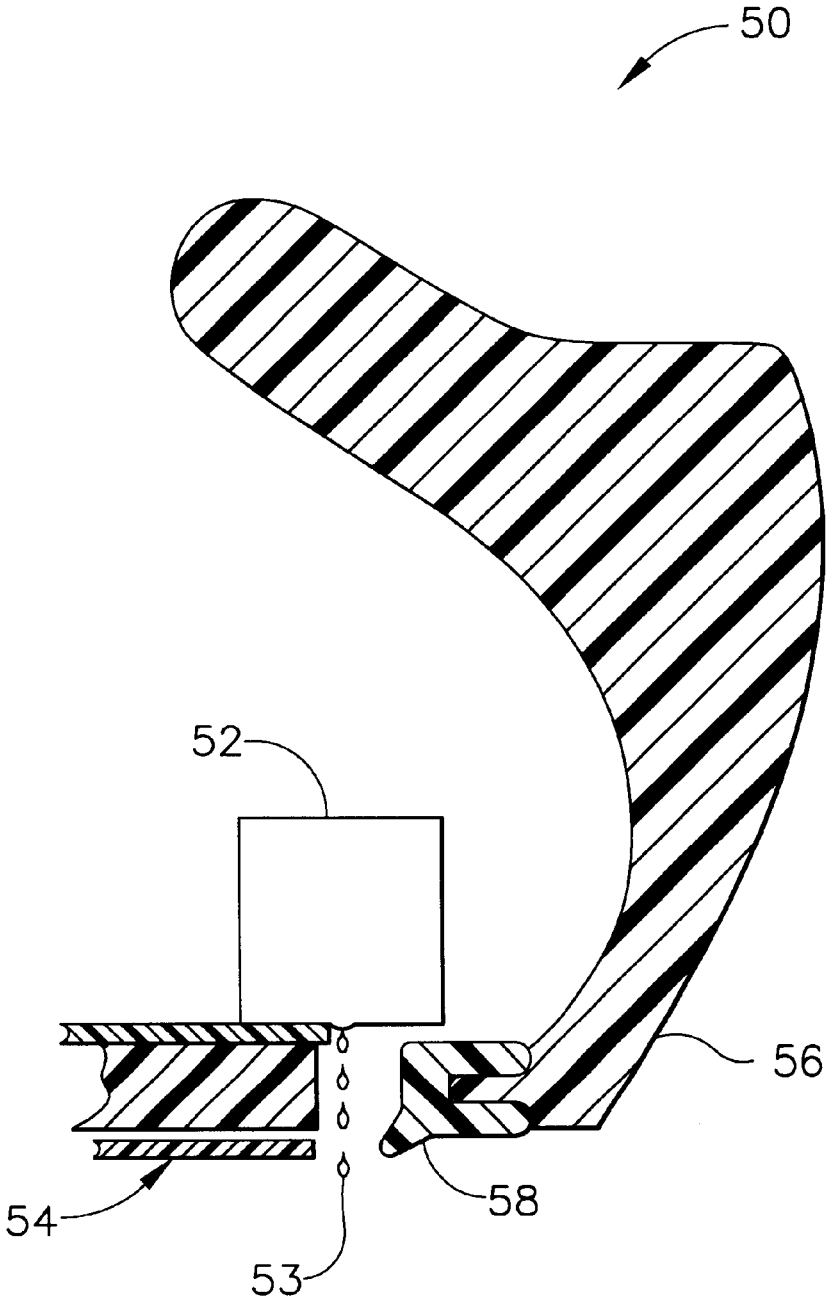
FIG. 1 is a cross-sectional view of an eyelid relative to a catcher, with the eyelid in an open position to allow ink drops to exit the printhead.

Referring now to the drawings, FIG. 1 shows a cross sectional view of a portion of an ink jet printhead 50. A drop generator 52 is situated in an area above a catcher assembly 54 and an eyelid seal 58. The eyelid is in the open position, which allows ink drops 53 to exit the printhead. When the eyelid is moved to the closed position, the eyelid seal 58 presses against the bottom edge of the catcher 54 to contain ink within the printhead on startup and shutdown of the printer system.

Figure 2:
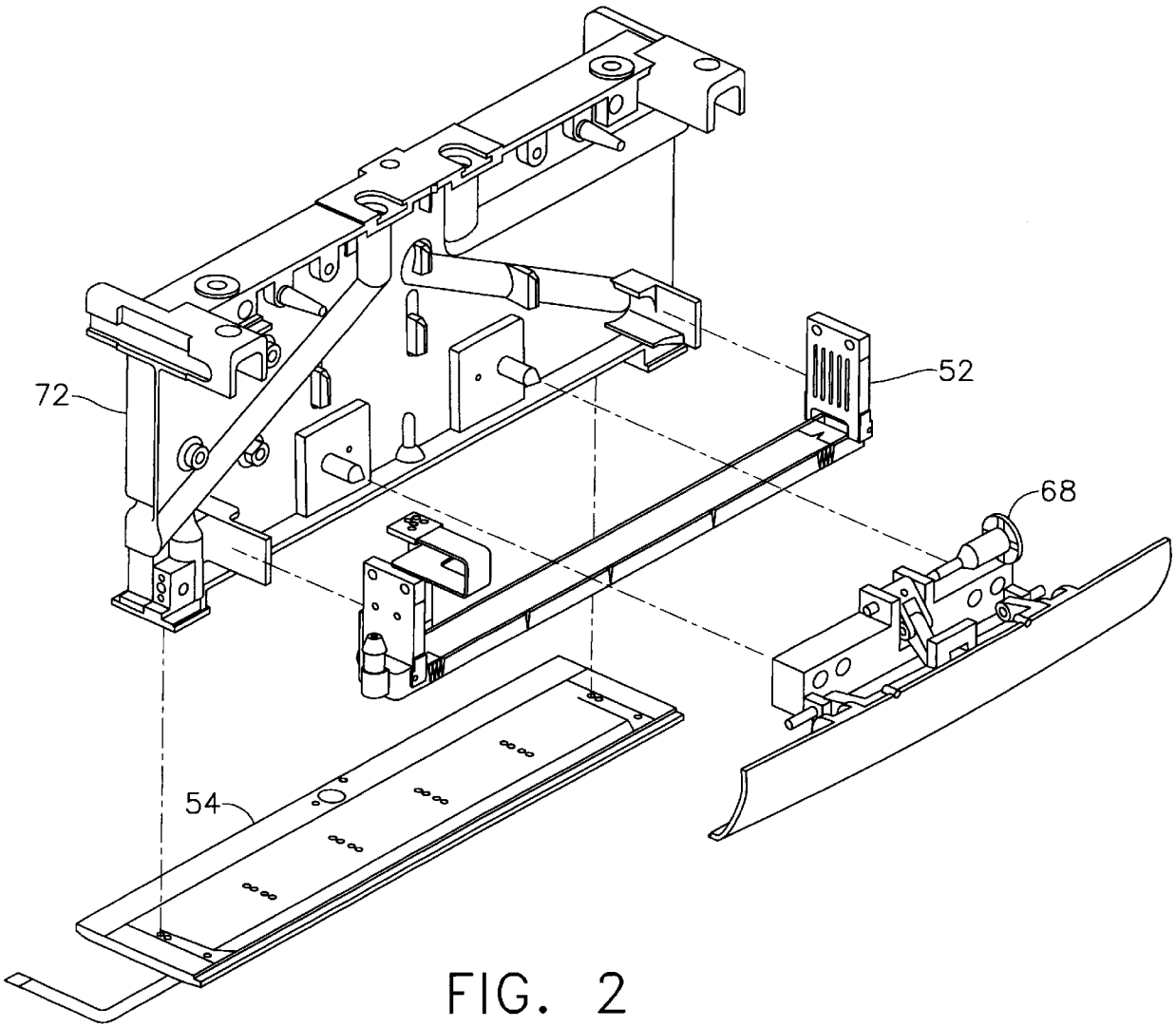
FIG. 2 is an exploded view of a printhead structure.

As shown in an exploded view in FIG. 2, the drop generator, 52, catcher 54 and eyelid assembly 68 are all mounted to a common printhead frame 72. During assembly the catcher is secured to the printhead frame 72. The drop generator is then precisely aligned with the catcher as required to properly select print and non-print drops. It is secured to the printhead frame to maintain the precise alignment. The eyelid assembly can then be mounted to the printhead frame. The eyelid assembly means 68 includes actuator means that can move the eyelid to a sealed position for startup and shutdown, and to an open position for printing to allow ink drops to pass between the catcher and the eyelid and be printed on a print media. It has been determined that for proper operation of the printhead, it is necessary to align the eyelid with the drop generator and the catcher with fairly tight tolerances. Fabricating the components to the tolerance required to meet these tight tolerances is expensive, as a result of the complexity of the printhead frame 72 and number of parts in the eyelid assembly 68.

Figure 3:
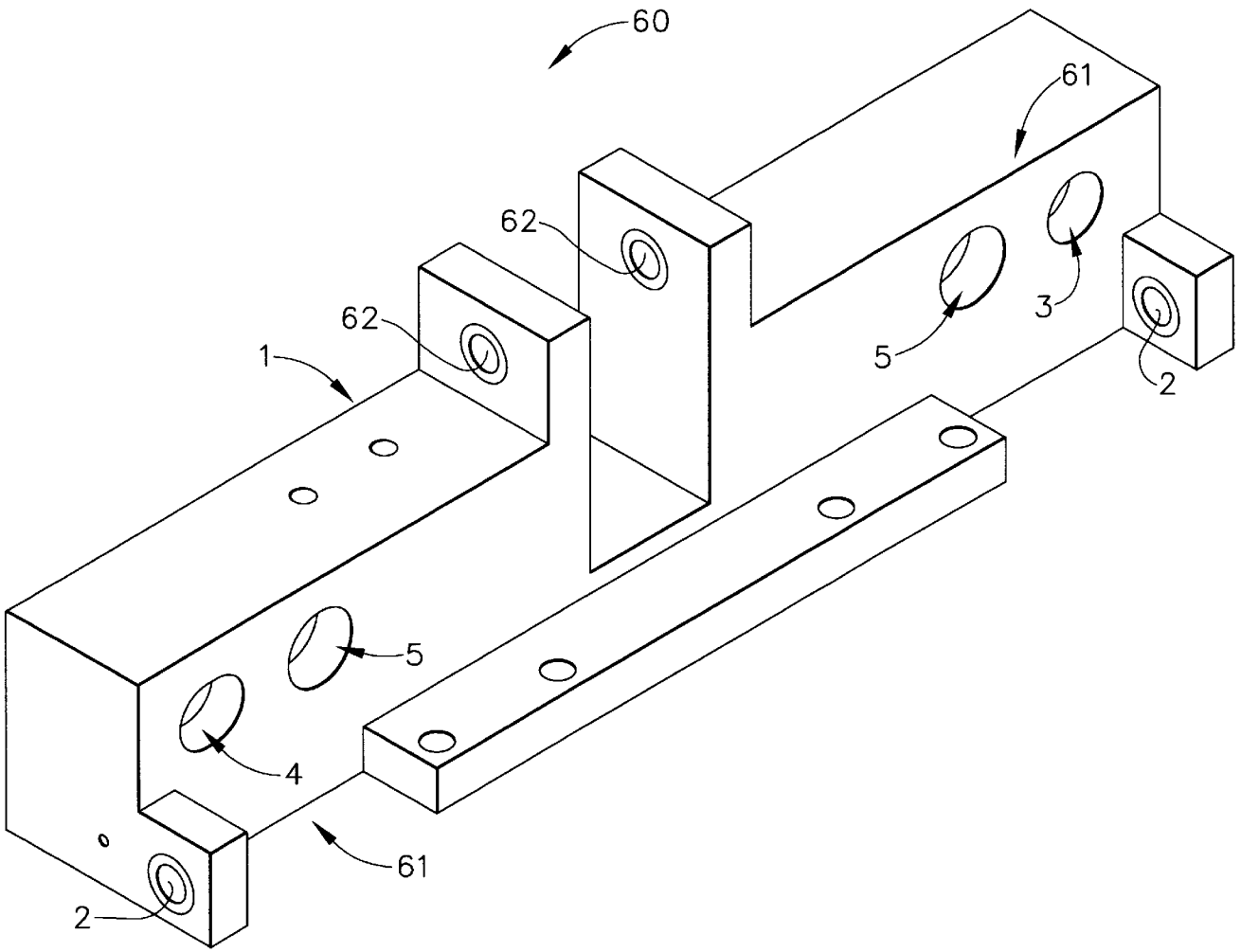
FIG. 3 (PRIOR ART)
FIG. 3 is a prior art mounting bracket for the multiple link eyelid system suitable for incorporation of the technique of the present invention.

FIG. 3 discloses a prior art mounting bracket 60 of the multiple link eyelid system 68 used to mount the eyelid assembly 68 to the printhead frame 72. The mounting bracket 60 comprises a base 1, containing bearings 2 and 62 through which other links pivot. The base 1 can be aligned to a printhead frame 72, shown in FIG. 2, by means of a frame mounting means 61. The frame mounting means 61 is comprised of round locating aperture 3, slotted locating aperture 4, and screw receiving means 5. The round and slotted locating apertures 3, 4, mate to pins 43 on the printhead frame 72 in FIG. 2. The base 1 is then fastened to the printhead frame by two captive screws, not shown, via screw receiving means 5. The eyelid bearings 2 and pivots 62 for the eyelid linkage arms are rigidly connected to the mounting and aligning features.

Figure 4:
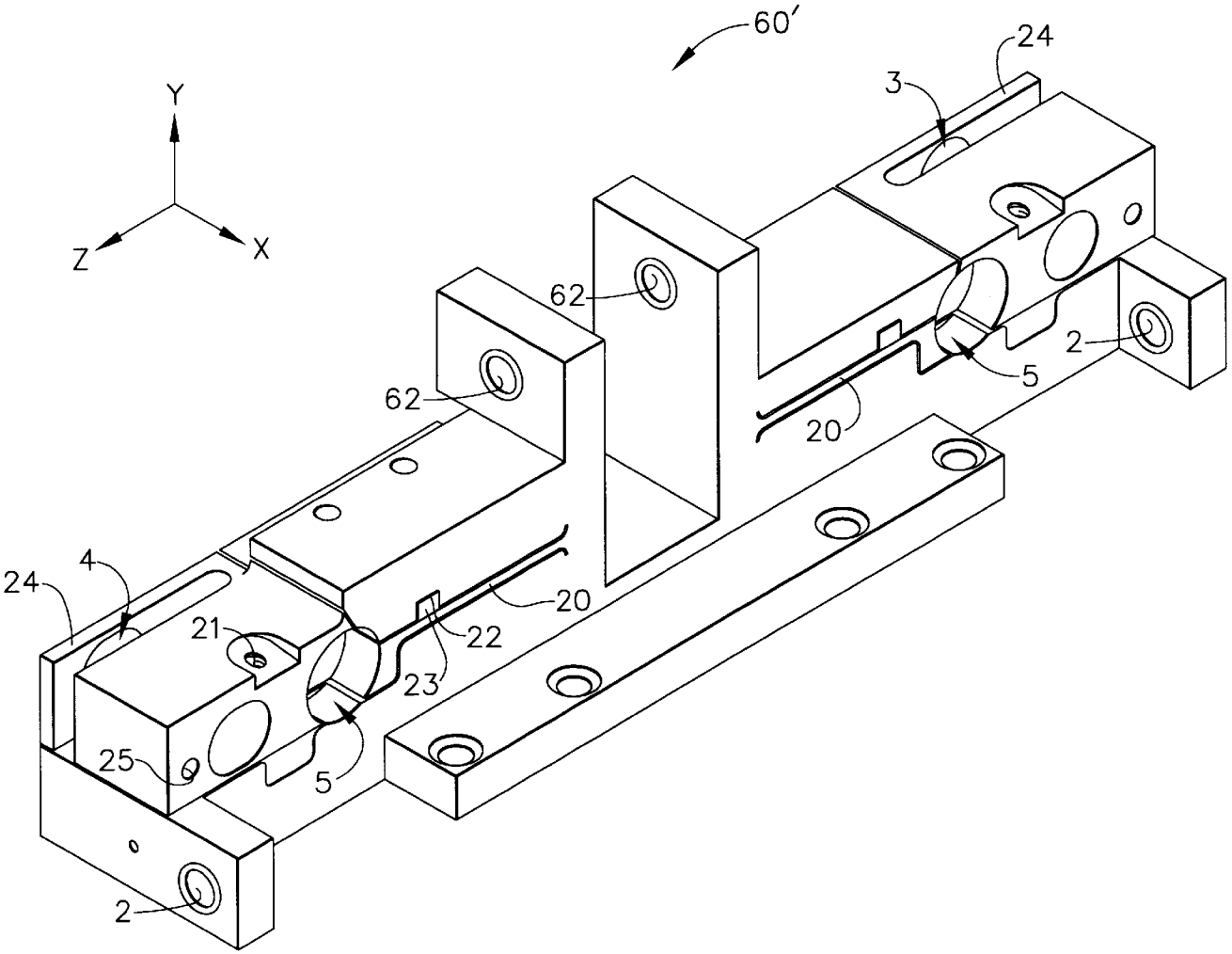
FIG. 4 illustrates the mounting bracket for the multiple link eyelid system of FIG. 2, incorporating the improved eyelid positioning technique of the present invention.

The present invention is illustrated in FIG. 4. In FIG. 4, the structure 60' comprises a pair of flexures 20, added to the structure 60 of FIG. 3. The flexures 20 are interposed between the frame mounting means 61 and the portion of the base 1 having pivot points 2 and 62. The flexures will allow for precise positioning of the rubber seal 58 of the eyelid relative to the catcher.

Figure 5A:
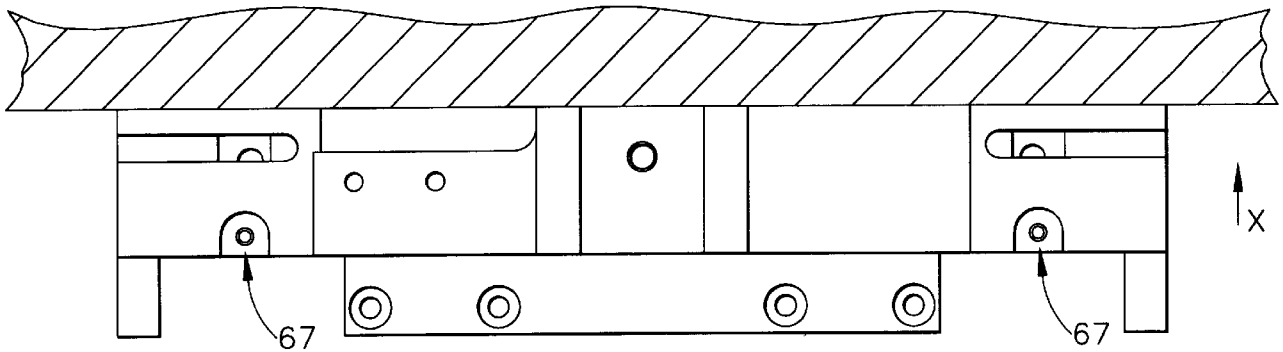
FIGS. 5A and 5B show top and front views of the mounting bracket to illustrate the vertical alignment function of the present invention.
Figure 5B:
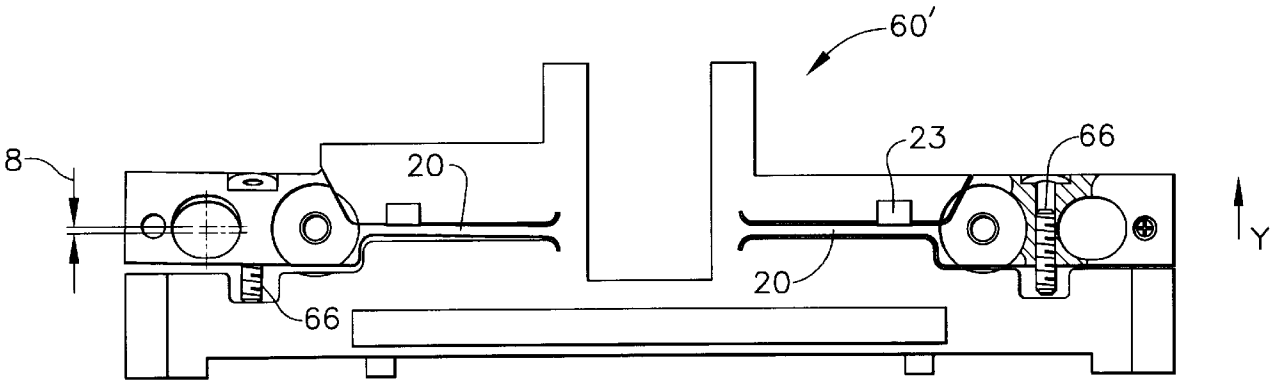

Continuing with FIG. 4, and referring also to FIGS. 5A and 5B, the flexure 20 is preloaded by a rubber insert 23, which is placed in slot 22. The insert 23 is larger than the slot 22, deflecting the mounting means on the flexure 20 down relative to the pivot points 2 and 62. The mounting means 61, comprised of round and slotted locating apertures 3, 4 and screw receiving means 5 which are located at the ends of the flexures, are then positioned vertically in the proper relation to the pivot points 2 and 62 by an adjustment means 66 in aperture 67.

The adjustment means can be any suitable means, such as a screw means, such as a set screw, inserted into the aperture or tapped hole 67. The adjustment means can be locked into position by using a Loctite style threadlocker, an opposing screw, locknuts, epoxy potting, or using any other suitable means to prevent the adjustment means or screw from shifting.

In another embodiment, the adjustment means could comprise a dowel pin placed in aperture 67. External force actuator means could be used to apply forces to the dowel pin to affect the deflection of the flexure means 20. Once the flexures are properly positioned, the dowel pins could be secured into the apertures by means of cyanoacrylate adhesives. In this manner, no screws are left in the eyelid adjustment means for the eyelid. Similarly, the flexures could be manipulated by external force actuators or screws, and the assembly glued or potted, to maintain the desired position, leaving no screws in the eyelid.

The adjustment means or screw means 66 compresses insert 23 and deflects flexure 20, as illustrated in FIG. 5B, allowing the location in the vertical or y direction, parallel to the jet streams, to be precisely adjusted. The two sides are adjusted independently of each other, which compensates for the tilt of the assembly about the x-axis, where the x-axis is perpendicular to the jet array. The z-axis, then, would be parallel to the array of orifices. The alignment flexure means therefore provides a first shifting means for shifting the alignment of the eyelid in a direction substantially parallel to the ink jets.

Figure 6A:
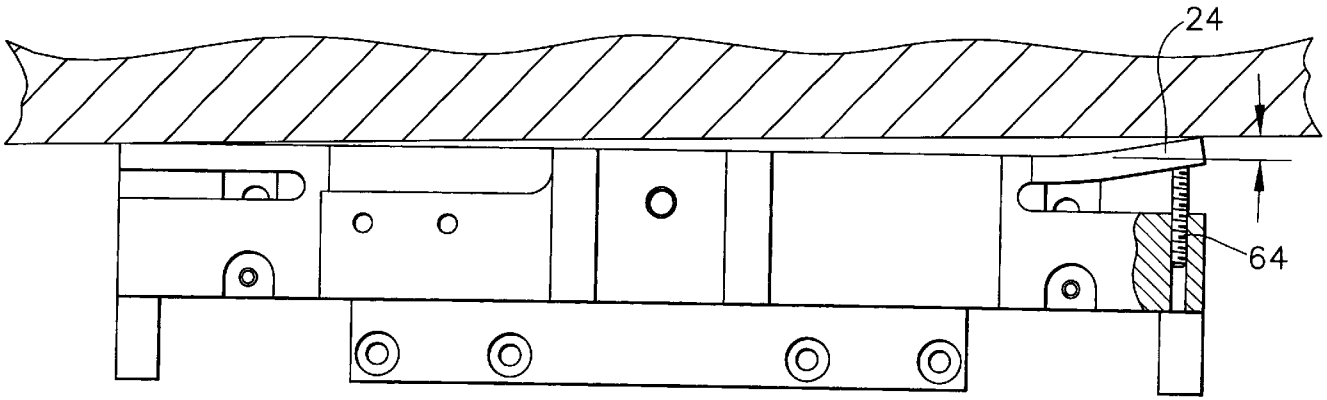
FIGS. 6A and 6B show top and front views of the mounting bracket to illustrate the capability of the present invention to alignment the spacing between the eyelid and the catcher radius.
Figure 6B:
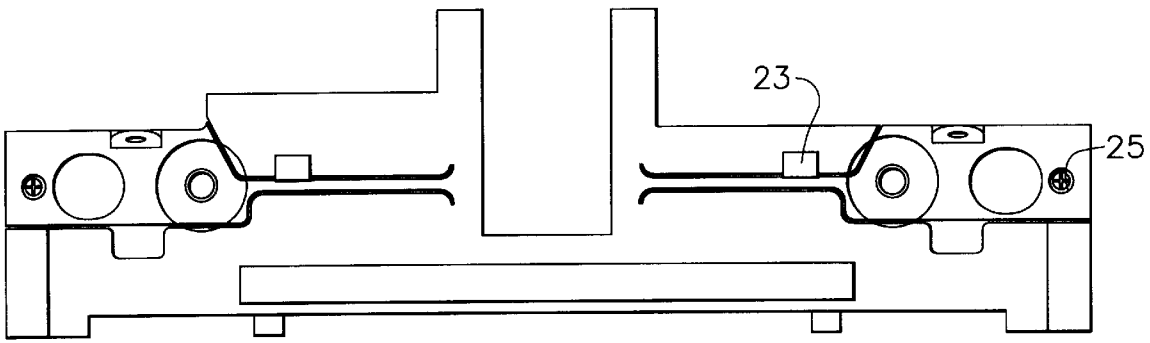

Continuing with FIG. 4, a second pair of flexures 24 is provided to adjust the rotation of the base 1 about the y axis. Flexure 24 is deflected by a screw means 64, shown in FIGS. 6A and 6B, in tapped hole 25. As this flexure is bent back, it pushes against the printhead frame upon which the mounting bracket is mounted. The result is that the pivot points 2 and 62 are moved out away from the printhead frame. The alignment flexure means therefore provides a second shifting means to shift the alignment of the eyelid in a direction substantially perpendicular to the ink jets and perpendicular to the array of orifices. In general, eyelid position in the x direction is not critical, but it is important to ensure parallelism between the eyelid and the catcher. Therefore, typically only one flexure 24 is flexed back against the printhead frame on a given assembly, thereby adjusting only rotation about the y-axis. In accordance with the present invention, the shifting is typically comprised of rotation and/or translation of the eyelid with respect to the various axes of jets/catcher. A first screw means deflects the alignment flexure means to allow rotation and translation in a direction parallel to the ink jets that are to be precisely positioned. Furthermore, the alignment of the eyelid can be shifted in a direction substantially perpendicular to the ink jets and perpendicular to the array of orifices. In this manner, first and second pairs of flexures allow the eyelid to be aligned independently, relative to two non-parallel axes.

The flexures of the present invention may be formed by conventional machining for flexures 24 and slotted by electro-discharge machining (EDM) for flexures 20, or formed by other means. EDM is the preferred method to make long, narrow flexures such as 20, as there are no cutting forces to deform the flexure in its manufacture. The narrow cut also serves to limit the maximum deflection of the flexure, ensuring the material is not permanently deformed.

The present invention, therefore, comprises at least one alignment flexure means for precisely positioning the eyelid relative to the catcher or the drop generator during assembly of the printer system. The flexure means remains essentially rigid during the actuation of the eyelid. Specifically, the at least one alignment flexure means comprises a first pair of flexures and a second pair of flexures, with a first shifting means for shifting alignment of the eyelid in a direction substantially parallel to the ink jets. A first side of the pair of the flexures can be adjusted independently of a second side of the pair of flexures. Furthermore, the second pair of flexures is deflected by the screw means. A second shifting means shifts alignment of the eyelid in a direction substantially perpendicular to the ink jets and perpendicular to the array of orifices.

While the flexures described thus far have been incorporated into the base of the eyelid mounting assembly, it is possible to incorporate eyelid aligning flexures into other components of the eyelid assembly or even into the printhead frame. As it is desirable to move the entire eyelid mechanism as a whole, the mounting bracket 60 which serves as the base of the multiple arm eyelid actuator linkage, is the preferred component for including the flexure means. The eyelid contains switches that operate according to the relative positions of the parts. By moving the entire eyelid relative to the mounting bracket 60, these relationships are unchanged. If desired, the flexure can be set at assembly, so that the flexure part is essentially rigid during the opening and closing operation when other components slide or pivot to provide the motion.

Having described the invention in detail and by reference to the preferred embodiment thereof, it will be apparent that other modifications and variations are possible without departing from the scope of the invention defined in the appended claims.

What is claimed is:

1. An ink jet printer system, comprising:

a. an ink jet printhead having a drop generator and a catcher located adjacent to the ink drop generator;

b. an eyelid for sealing against the catcher to contain ink within the printhead on startup and shutdown of the printer system;

c. an eyelid actuator assembly means for moving the eyelid into a sealed position for startup and shutdown and into an open position so that ink jets comprised of ink drops can exit an array of orifices and pass between the catcher and the eyelid to print on a print media; and d. at least one alignment flexure means for precisely positioning the eyelid relative to the catcher or the drop generator during assembly of the printer system, wherein the at least one alignment flexure means remains essentially rigid during the actuation of the eyelid.

2. An ink jet printer system as claimed in claim 1 wherein the at least one alignment flexure means comprises at least one pair of flexures, allowing alignment shifts of the eyelid to be made relative to two non-parallel axes.

3. An ink jet printer system as claimed in claim 2 wherein a first side of the at least one pair of flexures is adjusted independently of a second side of the at least one pair of flexures.

4. An ink jet printer system as claimed in claim 2 wherein the at least one pair of flexures is deflected by at least one screw means.

5. An ink jet printer system as claimed in claim 2 wherein the at least one pair of flexures can be manipulated by external force actuator or screw means.

6. An ink jet printer system as claimed in claim 1 wherein the at least one alignment flexure means provides a first shifting means for shifting alignment of the eyelid in a direction substantially parallel to the ink jets.

7. An ink jet printer system as claimed in claim 1 wherein the at least one alignment flexure means provides shifting means to shift alignment of the eyelid in a direction substantially perpendicular to the ink jets and perpendicular to the array of orifices.

8. An ink jet printer system as claimed in claim 1 wherein the least one alignment flexure means is preloaded by a rubber insert placed in a slot, the rubber insert being larger than the slot to allow deflection and flexure preload.

9. An ink jet printer system as claimed in claim 1 further comprising a first screw means for deflecting the least one alignment flexure means, to allow translation and rotation in a direction parallel to the ink jets to be precisely adjusted.

10. An ink jet printer system as claimed in claim 1 wherein the at least one alignment flexure means provides means to shift the alignment of the eyelid in a direction substantially perpendicular to the ink jets and perpendicular to the array of orifices.

11. An ink jet system as claimed in claim 1 further comprising a printhead frame to which the drop generator, catcher, and eyelid actuator assembly means are each attached.

12. An ink jet system as claimed in claim 1 wherein the at least one alignment flexure means is incorporated into a base of the eyelid actuator assembly means by which the eyelid actuator assembly means are attached to other printhead components.

13. An ink jet system as claimed in claim 1 wherein the eyelid actuator assembly means comprises a multiple arm linkage to actuate the eyelid.

14. An ink jet system as claimed in claim 1 further comprising a locking means for locking the at least one alignment flexure means in position.

* * * * *